United States Patent [19]

Haneda et al.

[11] 4,431,296

[45] Feb. 14, 1984

[54] DEVELOPING METHOD AND APPARATUS THEREFOR

[75] Inventors: Satoshi Haneda; Masahiko Itaya, both of Hachioji; Makoto Tomono, Hino, all of Japan

[73] Assignee: Konishiroku Photo Industry Co., Ltd., Tokyo, Japan

[21] Appl. No.: 370,535

[22] Filed: Apr. 21, 1982

[30] Foreign Application Priority Data

Apr. 27, 1981 [JP] Japan ..... 56-62526
Apr. 30, 1981 [JP] Japan ..... 56-63967

[51] Int. Cl.[3] ..... G03G 15/00

[52] U.S. Cl. ..... 355/3 DD; 355/14 D; 118/654; 430/122

[58] Field of Search ..... 355/3 DD, 14 D; 430/35, 430/36, 120, 122; 118/654, 657

[56] References Cited

U.S. PATENT DOCUMENTS

| | | | |
|---|---|---|---|
| 3,646,910 | 3/1972 | Cade et al. | 118/654 |
| 3,818,864 | 6/1974 | Bickmore | 355/3 DD X |
| 3,962,992 | 6/1976 | Takagi et al. | 118/654 |
| 3,973,517 | 8/1976 | Hudson | 110/654 |
| 4,033,292 | 7/1977 | Klingenberg | 118/654 X |
| 4,089,297 | 5/1978 | Morita et al. | 355/3 DD X |
| 4,095,980 | 6/1978 | Satomi | 430/122 |
| 4,265,197 | 5/1981 | Toyono et al. | 430/122 X |
| 4,292,387 | 9/1981 | Kanbe et al. | 430/122 X |
| 4,299,900 | 11/1981 | Mitsuhashi et al. | 430/122 |
| 4,336,318 | 6/1982 | Fukumoto et al. | 430/122 X |

*Primary Examiner*—A. C. Prescott
*Attorney, Agent, or Firm*—James E. Nilles

[57] ABSTRACT

A developing apparatus comprising a developing agent conveyor for conveying a developing agent, said developing agent conveyor including a multiplicity of pairs of electrodes each composed of a first electrode and a second electrode faced to said first electrode through a charging space so that an alternating electric field is generated in said charging space by the coactions of said first and second electrodes. A developing method characterized: in that a developing agent is introduced into a developing agent cloud forming space, in which an alternating electric field is to be generated, so that said developing agent may be made to fly therein by the action of said alternating electric field thereby to form the cloud of said developing agent; and in that the cloud of said developing agent is guided to a developing region thereby to develop a latent image, and by a developing apparatus comprising: an endless developing agent conveyor adapted to move in a manner to face a moving latent image retainer; a developing agent supply mechanism for supplying a developing agent to said endless developing agent conveyor; and an alternating electric field generating mechanism for establishing an alternating electric field in that developing agent cloud forming space of said endless developing agent conveyor, which is located in a region close to said latent image retainer.

10 Claims, 51 Drawing Figures

DEVELOPING METHOD AND APPARATUS THEREFOR

BACKGROUND OF THE INVENTION

1. Field of the Invention

The present invention relates to a developing method for developing either the electrostatic latent image, which is formed by the electronically photographic process, the electrostatic recording process, the electrostatic printing process or the like, or the latent image such as the magnetic latent image which is formed by the magnetic printing process, and a developing apparatus therefor.

2. Description of the Prior Art

As a system for developing an electrostatic latent image to form a visible image, generally speaking, there have been known to the prior art both a wet type developing system using a liquid developing agent and a dry type developing system using a powdered developing agent. The latter system, which resorts to the dry process so that it is superior in that it needs no volatile solvent, is further divided in a rough manner into two systems, i.e., the system using a two-component developing agent composed of a carrier and a toner and the system using a one-component developing agent composed only of a toner.

Thus, the developing system using the one-component developing agent is superior to the system using the two-component developing agent in that no change in the toner concentration essentially takes place to simplify the construction of the developer and in that the characteristics of the developing agent are not deteriorated but can be retained stable for a long time. In another aspect, however, the system using the one-component developing agent has a serious defect that the stable formability of a picture image cannot be attained. This defect is caused by the fact that it is difficult to charge the one-component developing agent to a desired state and to apply the developing agent at a desired state to an electrostatic charge retaining member when in the developing operation.

In order to attain an excellent visible image by the dry type developing system, more specifically, it is necessary to charge the toner such that it acquires a polarity opposite to that of the electrostatic latent image to be developed and such that it is brought into a state having a proper level. In the system using the two-component developing agent, the toner is frictionally charged by mechanically stirring the toner and the carrier so that the charged polarity and extent of the toner can be considerably controlled by selecting the characteristics of the carrier, the stirring condition and so on. In the one-component developing agent composed only of the toner, on the contrary, there exists no such carrier thereby to make it remarkably difficult to control the charged polarity and extent of the toner.

As one of the aforementioned developing methods using the one-component developing agent, there has been known in the prior art the so-called "powder cloud method" (which should be referred to the specification of U.S. Pat. No. 2,725,304). By blowing out the powders of a developing agent from a nozzle-shaped metal tube, according to that method, the developing agent particles are charged by the contacting friction, and the cloud of the developing agent is simultaneously formed at a sprayed state and is applied to an electrostatic latent image so that it may be developed. According to this method, the respective developing agent particles can migrate in accordance with the electric lines of force established by the electrostatic latent image, thus making it possible to attain a visible picture image having a high resolution.

In the prior art, however, not only since the charged state of the developing agent cannot be properly controlled, as has been described hereinbefore, but also since there is known no proper means for forming the cloud of the developing agent at a stable state and since the developing agent is scattered in accordance with the formation of the developing agent cloud thereby to raise a serious problem, the powder cloud method thus far described has been put into little practice. Although there has also been proposed another powder cloud method (which should be referred to Japanese Patent Publication Laid-Open to Public Inspection No. 73,067/78) using a two-component developing agent and taking the control of the charged state of the developing agent into consideration, the defects resulting from the use of the two-component developing agent such as the contamination due to the scatter of the toner or the fog in the electrostatic latent image retaining member are not improved in the least because the toner is scattered by mechanical means according to the method considered thereby to form the cloud.

On the other hand, the developing apparatus according to the prior art has defects that it is necessary to provide a developing agent charging mechanism, which is independent of the developing agent conveyor, so as to charge the developing agent so that the developing apparatus as a whole has its size considerably enlarged by that developing agent charging mechanism, and that it is difficult to sufficiently satisfy the requirement for a high positional accuracy or the like.

SUMMARY OF THE INVENTION

It is, therefore, an object of the present invention to provide a developing apparatus which is freed from the defects thus far described, which is enabled to charge a developing agent to a desired charged state thereby to ensure the excellent development and which has its occupied spaced reduced and its whole construction simplified.

Another object of the present invention is to provide a developing method which is enabled to form a developing agent cloud at a stably controlled state so that a latent image can be developed with a high resolution.

A further object of the present invention is to provide a developing apparatus which is enabled to advantageously embody the aforementioned developing method.

These objects are achieved by a developing apparatus comprising a developing agent conveyor for conveying a developing agent, said developing agent conveyor including a multiplicity of pairs of electrodes each composed of a first electrode and a second electrode faced to said first electrode through a charging space so that an alternating electric field is generated in said charging space by the coactions of said first and second electrodes.

These objects of the present invention can be respectively achieved by a developing method characterized: in that a developing agent is introduced into a developing agent cloud forming space, in which an alternating electric field is to be generated, so that said developing agent may be made to fly therein by the action of said alternating electric field thereby to form the cloud of said developing agent; and in that the cloud of said developing agent is guided to a developing region thereby to develop a latent image, and by a developing apparatus comprising: an endless developing agent conveyor adapted to move in a manner to face a moving latent image retainer; a developing agent supply mechanism for supplying a developing agent to said endless developing agent conveyor; and an alternating electric field generating mechanism for establishing an alternating electric field in that developing agent cloud forming space of said endless developing agent conveyor, which is located in a region close to said latent image retainer.

Other objects and features of the present invention will be made apparent from the following description taken in conjunction with the accompanying drawings.

DESCRIPTION OF THE PREFERRED EMBODIMENTS

In the present invention, a one-component developing agent (which will be shortly referred to as "toner") is used and is charged by the action of an alternating electric field thereby to simultaneously form a toner cloud (which will be shortly referred to as a "could"). First of all, the principle of those operations will be described in the following.

Figure 1:
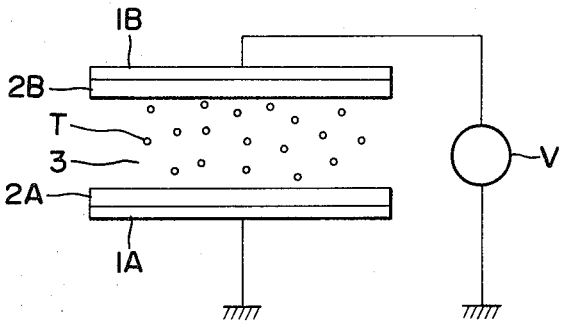
FIGS. 1 to 3 are explanatory views illustrating on principle the constructions of a portion corresponding to each of toner cloud forming spaces according to the present invention.

In FIG. 1, reference characteristics 1A and 1B indicate a pair of electrode plates faced to each other, of which the electrode plate 1A is grounded to the earth whereas the other electrode plate 1B is connected with an a.c. power source V. On the facing inner sides of the electrode plates 1A and 1B, there are mounted a pair of charging members 2A and 2B, which define inbetween a cloud forming space 3. If the toner T is introduced into that cloud forming space 3 and if an alternating electric field is formed in that space 3 through the electrode plates 1A and 1B by the a.c. power source V, the toner T is made to fly in said cloud forming space by the action of that alternating electric field so that a cloud is formed while having the particles of the toner T charged. This mechanism is as follows.

Specifically, the toner T is granular so that it is slightly charged even at its natural state. And, the toner T is finally charged, even if it is not at a charged state in the least, by the frictions either between the particles or between a developing agent conveyor, an equipment, the wall of the apparatus and so on until it is introduced into the cloud forming space 3.

If an electric field is applied, moreover, a coulomb force is exerted upon said toner particles as a result either that the toner particles are already charged although slightly or that charges are injected into the particles if these particles are conductive. Thus, if the alternating electric field is exerted as in the above, the toner particles are vibrated in accordance with the alternating vibrations of the electric field. During the half period of the voltage of the alternating power source V, more specifically, the toner particles fly in the cloud forming space 3 in a direction toward the charging member 2A or 2B until they impinge upon the latter. During the subsequent half period, the toner particles fly in the opposite direction until they impinge upon the charging member 2B or 2A. These operations are repeated until the cloud is formed at that state. Moreover, the toner particles are charged by the frictions when they impinge upon the charging member 2A or 2B.

Now, the charged polarity of the toner T due to those frictions is determined by the relationships between the material of the charging members 2A and 2B and the toner T in the frictionally charging order. As a result, the toner T is charged to an arbitrary polarity, i.e., a positive or negative by selecting the material of those members such that the toner T is resultantly charged at a desired polarity.

Figure 2:
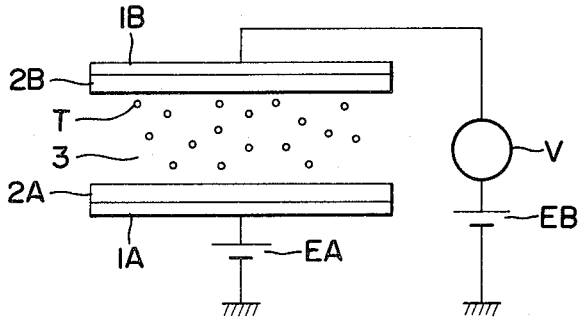
Figure 3:
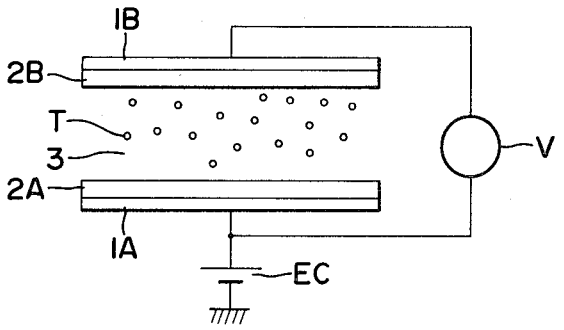

In case the toner T is conductive, its particles are subjected to the injections of the charges from the charging members 2A and 2B so that not only particles charged at one polarity but also particles charged at the other polarity are produced by the construction of FIG. 1. For this, the following means is effective, in which one of the charging members 2A and 2B is brought into such a state as have one of the charging members 2A and 2B biased with a predetermined polarity, either by connecting the electrode plate 1A with a d.c. power source EA, as shown in FIG. 2, and by superposing the voltage of a d.c. power source EB upon the a.c. power source V or by connecting a common d.c. power source EC with the electrode plate 1A and the a.c. power source V, as shown in FIG. 3, whereby the toner particles, which are charged at such a polarity as is useless for the development, are absorbed and removed from the cloud. Incidentally, electric or magnetic means may desirably be used so that the toner particles charged at an unnecessary polarity may not be guided into the developing region.

In any case, in the forming operation of the cloud of the charged toner by the use of the aforementioned means, the vibrating state of the toner particles, i.e., the state of the cloud and the charged state of the toner particles are dominated by the voltage and frequency of the a.c. power source V and by the uses, polarities and voltages of the d.c. power sources EA, EB or EC, or, if the toner T is magnetic toner, by the magnitude and so on of the magnetic force applied. By selecting those conditions and the constructional condition of the cloud forming space 3, therefore, a cloud at a stable state can be formed of the toner particles which are properly charged. Even if the charging principles are different, moreover, the proper cloud formation can be achieved for any of insulating, conductive or other toners.

On the other hand, the fly of the toner T is effected by the alternating electric field, and the formation of the cloud is limited to the cloud forming space, which is defined by the charging members 2A and 2B, thereby to regulate the direction in which the toner is scattered to the outside.

In the description thus far made, the surfaces of the charging members 2A and 2B are practically required to have at least their portions made conductive, whereby the electric balance with the charges, which are formed on said charging member 2A or 2B as a result of the collisions against the toner particles, can be maintained so that the charges can be prevented from being accumulated thereby to prevent the formation of the cloud from being adversely affected. Moreover, if the aforementioned electrode plates 1A and 1B are made to function as the charging members, too, the independent charging members 2A and 2B can be dispensed with.

In the present invention, the toner is introduced into the cloud forming space 3 and is made to fly by the aforementioned cloud forming means thereby to form the cloud of the charged toner particles, which is further guided into the developing region thereby to develop the latent image.

Figure 4:
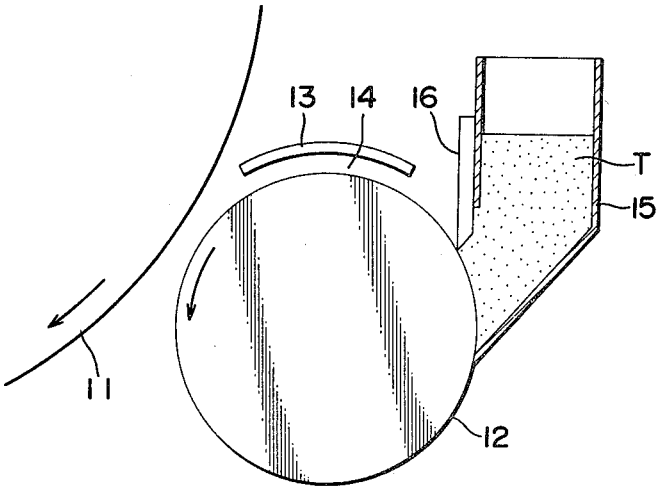
FIG. 4 is an explanatory view showing one example of the construction of a developing apparatus according to the present invention.

FIG. 4 shows one example of the developing apparatus to be used for practising the method of the present invention. In this example, reference numeral 11 indicates a latent image retaining drum which constitutes the latent image retaining member and which is made of a photoconductive and photosensitive material so that it is formed with an electrostatic latent image by the electronically photographic process or the like. In a manner to face the outer circumference of that latent image retaining drum, there is arranged a developing drum 12 which constitutes the toner conveyor and which is rotated in such a direction that the aforementioned latent image retaining drum 11 and its facing portion may proceed in the same direction. At a region upstream of that facing portion of that developing drum 12, which faces the aforementioned latent image retaining drum 11, there is arranged an electrode plate 13 which is positioned to face said developing drum 12 thereby to define a cloud forming space 14 therebetween. Although not shown, in other words, the developing drum 12 is used as a partner electrode plate in accordance with the aforementioned cloud forming manner thereby to establish the alternating electric field between the developing drum 12 and the aforementioned electrode plate 13.

To the developing drum 12, moreover, there is attached a toner hopper 15, and a toner supply regulating member 16 is interposed between the toner hopper 15 and the aforementioned cloud forming space 14.

In the developing apparatus having the construction thus far described, the toner T is supplied to the surface of the developing drum 12 from the toner hopper 15 so that the toner at a flow rate regulated by the toner supply regulating member 16 is introduced into the cloud forming space 14 thereby to form the cloud by the action of the aforementioned cloud forming manner. The cloud thus formed is so guided through diffusion, by the wind generated by the rotations of the developing drum 12, or by a cloud guiding mechanism exemplified in a later-described example that it is brought into contact with the outer circumference of the latent image retaining drum 11, whereby the electrostatic latent image on its retaining drum 11 is developed by electrostatically applying the toner particles which are charged at a polarity opposite to that of the electrostatic latent image.

In the description thus far made, the toner T is conveyed by the rotating developing drum 12 by making use of the electrostatically attracting force generated as a result of the frictional charging operation with the developing drum 12, by equipping the developing drum 12 with a brush, by making rough the surface of the developing drum 12, or by the micro-field process (which should be referred to the specification of U.S. Pat. No. 3,806,574). In case the toner T is magnetic, as in a later-described example, the conveyance making use of the magnetic force is also effective. The application of a d.c. voltage to that developing drum 12 is preferred because it is possible to strengthen the attracting force for attracting the toner T thereby to facilitate and ensure the conveyance of the toner T.

The supply rate of the toner to be introduced into the aforementioned cloud forming space 14 is sufficient if it is more than the rate required for the latent image on its retaining drum 11 to be finally developed to a sufficient extent, but the introduction of excess toner should be avoided because it raises a cause for deteriorating the quality of the visible picture image. This is because the toner T is a one-component type so that all of it are possibly used for the development of the latent image. Specifically, the supply rate of the toner to be introduced into the cloud forming space 14 is sufficient if several toner layers are formed on the developing drum 12. For this purpose, the toner supply regulating member 16 is used, but it is unnecessary in the present invention for the toner introduced into the developing region to form a thin layer having a uniform thickness on the developing drum 12, as is different from the developing method using the toner according to the prior art. Therefore, the toner supply regulating member 16 is sufficient if it steadily allows the toner to flow at a predetermined rate.

Figure 5A:
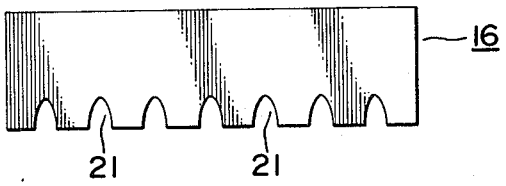
FIGS. 5(A) to 5(E) are explanatory views illustrating a variety of examples of a toner supply regulating member to be used in the present invention.
Figure 5B:
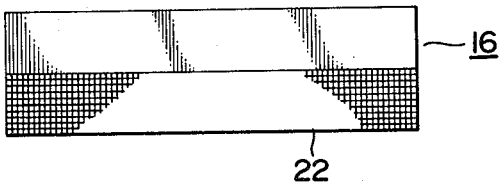
Figure 5C:
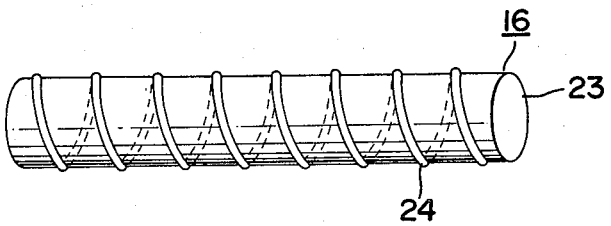
Figure 5D:
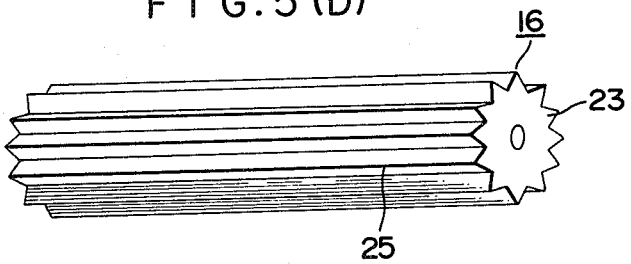
Figure 5E:
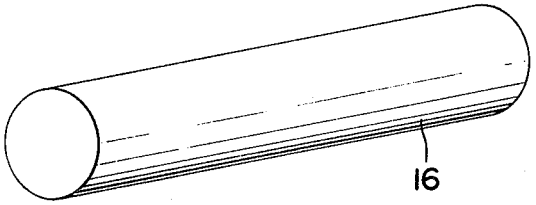

A plate-like blade having a knife edge is usually used as that toner supply regulating member 16. Alternatively, there can be used such toner supply regulating members 16 as illustrated in FIGS. 5(A) to 5(D). The member 16 of FIG. 5(A) is constructed into such a plate-like shape as has its leading edge formed with a number of notches 21. The member 16 of FIG. 5(B) is equipped with a net 22 at the leading edge portion of a plate-like member. The member 16 of FIG. 5(C) is so constructed that a helical land 24 is formed on the outer circumference of a rotary rod 23. The member 16 shown in FIG. 5(D) is a toner supply regulating member having such a construction that longitudinally extending lands 25 are formed on the outer circumference of the rotary rod 23. In the cases in which the toner T is magnetic and in which the toner conveying force of the developing drum 12 makes use of a magnetic force, it is effective to provide either a non-contact magnetic blade (which should be referred to Japanese Patent Publication Laid-Open to Public Inspection No. 125,844/78, for example) or a rod-shaped toner supply regulating member 16, which is made of a magnetizable material shown in FIG. 5(E), such that it is fixed or made rotatable in a manner to face the developing drum 12.

Figure 6A:
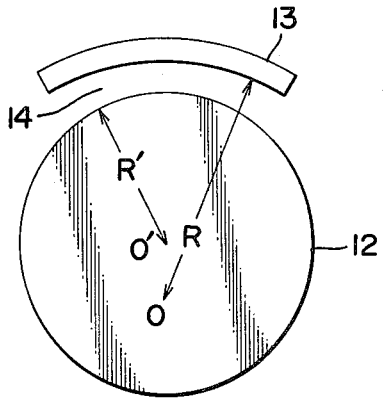
FIGS. 6(A) and 6(B) are explanatory views illustrating a developing drum and an electrode plate, respectively.
Figure 6B:
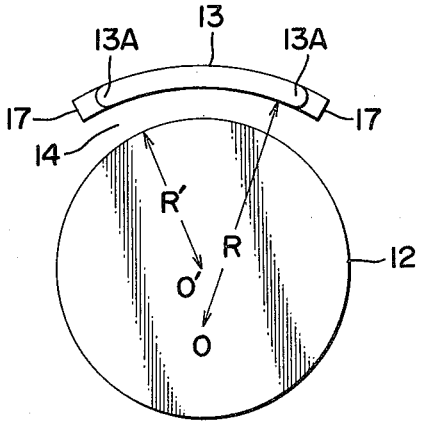

The electrode plate 13 for defining the cloud forming space 14 together with the developing drum 12 also has a function as a charging member and is usually sufficient if it is disposed in parallel with the developing drum 12 thereby to form the cloud forming space 14 having a uniform thickness. The thickness of this cloud forming space 14 is so set, while considering the characteristics of the toner T used, the magnitude of the alternating voltage applied, and so on, that the cloud may be effectively formed of the suitably charged toner particles. The aforementioned electrode plate 13 may have its inner side equipped with a charging member made of a resin, for example. Since a high voltage for establishing the alternating electric field is applied between that electrode plate 13 and the developing drum 12, however, discharge or thunderbolt phenomena are liable to take place between the end portions of said electrode plate 13 and the developing drum 12. In order to prevent these phenomena, it is effective either that, in order that the electrode plate 13 may be the more spaced from the developing drum 12 at both its ends than at its center, as shown in FIG. 6(A), for example, the electrode plate 13 has its center O located at a more distance than the center O' of the developing drum 12 thereby to have a larger radius R than the radius R' of the developing drum 12, or that the electrode plate 13 has both its end portions 13A and 13A rounded or further convered with insulating materials 17 and 17, as shown in FIG. 6(B).

In order to prevent the particles, which have flown in the cloud forming space 14, from being scattered to the outside until they go round to the back of the electrode plate 13, for example, moreover, it is effective either that there is provided a shielding plate for shielding the space between the toner supply regulating member 16 and the electrode plate 13, or that the electrode plate 13 has its end portions equipped with scatter preventing plates made of an insulating material.

Specifically, the thickness of the aforementioned cloud forming space 14 is made so larger than that of the layer of the toner introduced that the toner particles are enabled to sufficiently flow and is sufficient to be about 0.5 to 10 mm, for example, while taking it into consideration that the layer of the toner introduced usually has a thickness of about 10 to 100 microns. The a.c. voltage to be applied between the electrode plate 13 and the developing drum 12 by the a.c. power source may have a frequency of 50 Hz to 50 KHz and a voltage of 0.2 to 3 KV and may have an arbitrary waveform such as square, triangular or sinesoidal shapes.

Figure 7A:
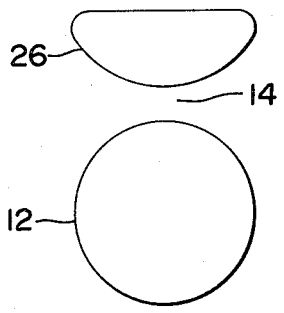
FIGS. 7(A), 7(B) and 7(C) are explanatory views illustrating the modifications of the members for defining the clould forming space, respectively.
Figure 7B:
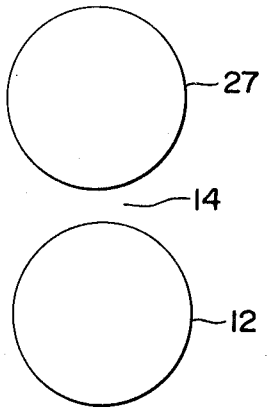
Figure 7C:
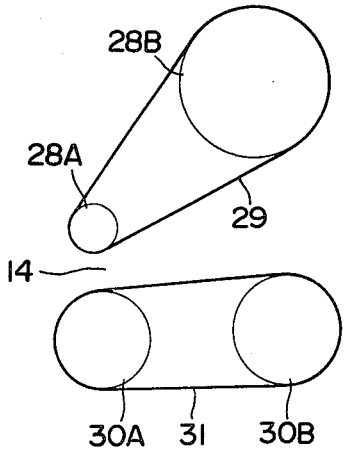

The member for defining the cloud forming space 14 together with the developing drum 12 should not be limited to the fixed plate-like electrode plate 13 or the electrode plate 13 equipped with the charging members but may be constructed of such a fixed sleeve 26 as shown in FIG. 7(A), such a juxtaposed drum 27 as is rotated in the cloud forming space 14 in the same direction as that of the developing drum 12, as shown in FIG. 7(B), or such a facing endless belt 29 as is made to run on a plurality of guide rollers 28A and 28B, as shown in FIG. 7(C). As shown together in FIG. 7(C), on the other hand, the developing drum 12 may be replaced by an endless developing belt 31 which is made to run on a plurality of guide rollers 30A and 30B. In case such endless belts are employed, said belts 29 and 31 are made conductive so that they are used as electrodes. Then, the length of the portions juxtaposed to run in a facing manner can be freely selected so that the cloud forming space 14 can be easily formed to have a desired length. In the example of FIG. 7(C), moreover, if the guide rollers 28A and 30A are juxtaposed to each other and used as the electrodes, the endless belts 29 and 31 can be used as the independent charging electrodes.

Figure 8:
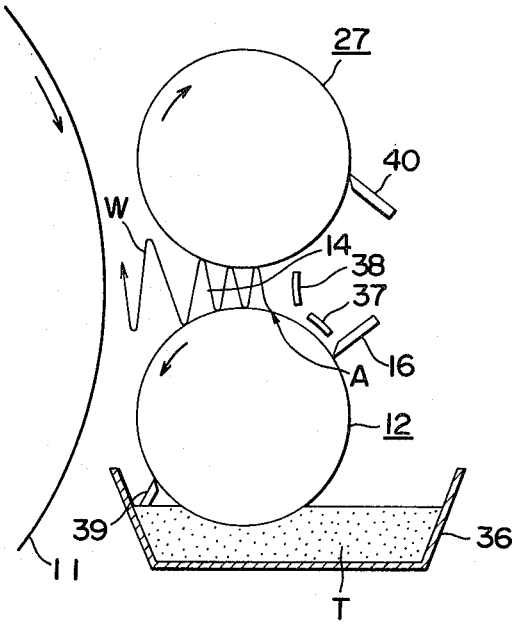
FIGS. 8 and 9 are explanatory views showing other embodiments of the construction of the developing apparatus according to the present invention, respectively.

FIG. 8 shows another example of the developing apparatus according to the present invention, in which the cloud forming space 14 is defined by the developing drum 12 and the juxtaposed drum 27 having a diameter equal to or different from that of the developing drum 12 and in which the toner supply mechanism is constructed of a toner tank 36. In this example, moreover, an electrode plate 37 for preliminary charging is disposed downstream of the toner supply regulating member 16 with respect to the developing drum 12, and a cloud guiding electrode 38 is disposed at a position to face the latent image retaining drum 11 through the cloud forming space 14. Reference numerals 39 and 40 indicate toner scraping blades for the developing drum 12 and the juxtaposed drum 27, respectively.

In the construction thus far described, by the action of the preliminary charging electrode plate 37, the toner T to be introduced into the cloud forming space 14 is preliminarily charged, and the magnitude of the alternating electric field between the developing drum 12 and the juxtaposed drum 27 is increased the more as the distance therebetween becomes the smaller. As a result, the toner particles start their vibrations at a certain position A, as designated at a curve W, for example, so that the cloud is formed in the cloud forming space 14 downstream thereof thereby to ensure its formation.

The cloud thus formed is so guided by the guiding force resulting from the rotations of the juxtaposed drum 27 in addition to the diffusion and the guiding force resulting from the rotations of the developing drum 12, as in the aforementioned examples, that it approaches the latent image retaining drum 11. In the example being considered, however, the guidance of that cloud can be dominately controlled by the action of the cloud guiding electrode 38. By applying a voltage having the same polarity as the charged polarity of the toner forming the cloud upon that cloud guiding electrode 38, more specifically, the cloud is enabled to move in the direction toward the latent image retaining drum 11 without fail.

More specifically, let it be assumed that a d.c. voltage is commonly applied between the developing drum 12 and the juxtaposed drum 27, for example, together with the a.c. voltage for establishing the alternating electric field. Then, if the toner particles of the cloud formed in the cloud forming space 14 are charged to have the same polarity as that of the aforementioned d.c. voltage, the cloud receives a stronger guiding force than that when said d.c. voltage is not applied from the aforementioned d.c. voltage in directions to escape from that cloud forming space 14, i.e., in the direction to approach the latent image retaining drum 11 (or leftwardly of FIG. 8) and in the direction to leave the same (or rightwardly of the same Figure). If the charged polarities of the aforementioned d.c. voltage and toner particles are set opposite, on the contrary, the cloud is trapped by the cloud forming space 14 until it sticks to the developing drum 112 or the juxtaposed drum 27. In this case, therefore, the guidance of the cloud is controlled by controlling the polarity and magnitude of the d.c. voltage applied upon the cloud guiding electrode 38 in accordance with the polarity and magnitude of the d.c. voltage and with the charged polarity and chargeability of the toner so that the cloud can be applied at a desired state to the latent image retaining drum 11.

It is quite natural that similar control can be effected notwithstanding that no d.c. voltage is applied upon either the developing drum 12 or the juxtaposed drum 27.

By the action of the cloud guiding electrode 38, as is apparent from the foregoing description, the cloud can be controlled, and the toner particles charged at a specified polarity can be selectively controlled. In case the cloud in the cloud forming space 14 contains both the positively charged toner particles and the negatively charged toner particles, therefore, only the toner particles charged at one polarity can be selectively applied to the latent image retaining drum 11.

According to the construction shown in FIG. 8, as has been described hereinbefore, the toner T is preliminarily charged by the action of the preliminarily charging electrode plate 37 so that the formation of the cloud can be facilitated and ensured and so that the cloud formed at a controlled stable state can be applied at a further controlled state to the latent image retaining drum 11. In relation to the latent image retaining drum 11, in addition, the juxtaposed drum 27 can be made to have a function similar to that of the developing drum 12 so that the space defined between the juxtaposed drum 27 and the latent image retaining drum 11 can be used as the developing region. As a result, the developing region at the latent image retaining drum 11 can be enlarged.

Of the toner particles forming the cloud, incidentally, the particles having failed to attach to the latent image retaining drum 11, i.e., those having failed to be used for the development can be applied to the developing drum 12 or the juxtaposed drum 27 and can be recovered into the toner tank 36 by the actions of the toner scraping blades 39 and 40.

Figure 9:
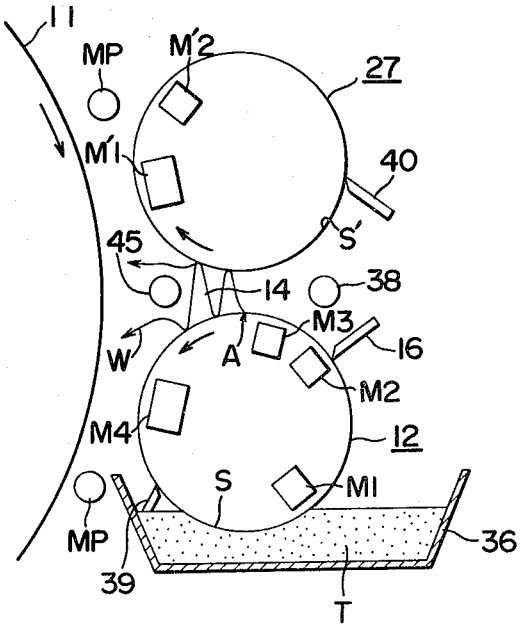

FIG. 9 shows another example of the construction of the developing apparatus according to the present invention, which is suitable in case magnetic toner is used as the toner T. In this example, the developing drum 12 is constructed of a rotary sleeve S and a group of magnets which are fixed in the internal space of that sleeve S. The magnet group is composed of: toner conveying magnets M1 and M2 which are disposed in the sleeve S at a position located in the toner tank 36 and at a position in the vicinity of the toner supply regulating member 16, respectively; a toner vibration preventing magnet M3 which is disposed in the sleeve S at a position close to the portion facing the juxtaposed drum 27 and which also has a toner conveying function; and a developing magnet M4 which is disposed in the sleeve S at a position close to the portion facing the latent image retaining drum 11 and which also has a function to prevent the toner from being scattered. On the other hand, the juxtaposed drum 27 is similarly constructed of a sleeve S' and a group of magnets. This magnet group is composed of: a developing magnet M'1 which is disposed in the sleeve S' at a position close to the portion facing the latent image retaining drum 11 and which also has a function to prevent the toner from being scattered; and a toner conveying magnet M'2 which is disposed downstream of that developing magnet M'1. Moreover, the cloud guiding electrode 38 is provided similarly to the example of FIG. 8, and there is additionally disposed in the cloud forming space 14 or a cloud guiding space downstream of the former a developing electrode 45 which is juxtaposed to the latent image retaining drum 11. Still moreover, toner scatter preventing magnets MP and MP are disposed to face the surface portion of the latent image retaining drum 11 downstream of the region, in which the latent image retaining drum 11 and the developing drum 12 are faced to each other, and the surface portion of the latent image retaining drum upstream of the region, in which the latent image retaining drum 11 and the juxtaposed drum 27 are faced to each other, respectively.

In the developing drum 12 of the construction thus far described, the magnetic toner T is conveyed by the magnetic forces of the magnets M1 and M2 when the sleeve S of the developing drum 12 is rotated. However, the toner particles are restricted from any vibration by the magnetic force of the magnet M3 until the restriction by that magnetic force is released. At last, the position A, at which the toner starts its vibrations, is controlled to make it possible to regulate the limit of the cloud forming space 14 at a side remote from the latent image retaining drum 11. As a result, the cloud is formed at a position close to the latent image retaining drum 11 so that the toner is prevented without fail from being scattered rightwardly of FIG. 9 by the action of the cloud guiding electrode 38, too.

Since there is provided the developing electrode 45, moreover, the migration of the toner particles in the cloud relative to the latent image retaining drum 11 can be controlled by applying a voltage upon the developing electrode 45, or the migration of the toner particles toward the latent image retaining drum 11 can be restricted by applying a voltage having the same polarity as that of the toner particles upon the developing electrode 45. Still moreover if an a.c. voltage is further applied in a superposed manner upon that developing electrode 45, the cloud holding effect can also be attained.

By making use of the fact that the toner T is magnetic, furthermore, the toner T can be prevented from being scattered to the outside by the actions of the toner scatter preventing magnets MP, MP and so on.

Incidentally, the conveyance of the toner by the developing drum 12 or the juxtaposed drum 27 can be effected by means for rotating the inside magnets while keeping the sleeve S or S' stationary, by means for rotating the sleeve S or S' together with the inside magnets, and so on.

The latent image retained on the latent image retaining drum 11 is developed when the toner forming the cloud is applied thereto. In this developing process, it is frequently effective to apply an a.c. or d.c. voltage or to apply a magnetic bias if the toner is magnetic. The powder cloud process thus far described belongs to the non-contact developing process. Such developing processes known as another touch-down or impression process belonging to the non-contact developing process as is disclosed in the specifications of U.S. Pat. Nos. 2,839,400 and 3,866,574 and Japanese Patent Publication Laid-Open to Public Inspection Nos. 18,656/80 and 17,417/77 characterized in that the toner layer charged or having charges injected thereinto is formed on the developing drum and is arranged to face the electrostatic latent image retaining drum so that it is made to fly by the a.c. or d.c. voltage applied thereby to effect the development. In these processes, therefore, since the toner directly participating in the development is made to form the layer before its fly, there is a large fear that the toner may flow in the aggregate form of plural or multiple toner particles. On the contrary, the powder cloud process to be used in the present invention has a sufficient possibility to basically achieve the excellent development with a high resolution because the cloud is applied to the latent image so that the respective toner particles can behave independently of one another.

In the present invention, normally, not only the formation and retention of the cloud but also the guidance of the formed cloud to the latent image can be accomplished at the sufficiently controlled states thereby to make it possible to apply the cloud at such an excellent state as accords with the state of the electrostatic latent image to be developed, the characteristics of the toner used, and other conditions. At last, the basically preferred advantages of the powder cloud process can be enjoyed without fail so that an excellent visible picture image having a high resolution can be attained at all times. Moreover, it is frequently effective to apply the a.c. or d.c. voltage in the developing operation, in which the cloud formed is applied to the latent image retaining drum 11.

In addition, since the charged conditions and so on of the cloud and the toner for forming the former can be substantially completely controlled, as has been described hereinbefore, the problem of the toner scatter, which should be said the essential defect of the powder cloud process, can be solved so that the external device or devices can be prevented from being contaminated. In the above example, the toner having failed to attach to the latent image retaining drum 11 is electrically or magnetically attracted to the developing drum 12 or the juxtaposed drum 27 so that it can be either recovered without fail or returned to the toner tank or the like.

The aforementioned examples shown in the drawings are all preferable ones and can be naturally modified in various manners. For example:

(a) The members for enjoying special operational effects, e.g., the preliminarily charging electrode, the cloud guiding electrode, the developing electrode or the toner vibration preventing magnets are preferred to be provided but are not essential to the present embodiment.

(b) The cloud can be retained by disposing the sleeves S and S' in the vicinity of the latent image retaining drum 11 and also the alternating electric field is formed in that vicinity region so that a wide cloud forming space can be formed. In this case, either the toner, which is still flying in the cloud forming space, or the toner, which has been recovered on the sleeves S and S', can be used for the non-contact development in dependence upon the distance therebetween. At last, in the case thus far described, a wide developing region is actually provided so that the excellent development can be effected.

The developing method thus far described according to the present invention can be applied not only in case the latent image is an electrostatic one but also in case the latent image of a magnetic one. In the latter case, the magnetic toner is used as the toner so that a more excellent visible picture image than that the attained by the magnetic brush developing method according to the prior art can be obtained.

Incidentally, the toner image formed by the developing process is fixed after it has been transferred directly or indirectly to paper or the like.

The present invention will be described in more detail in the following in connection with Examples.

The toners A, B and C used in the following Examples are prepared in the following manners:

Toner A (one-component insulating toner)

- Styrene-acryl resin [SBM 73] (Product of Sanyo Kasei Kogyo Co., Ltd.)—60 wt. parts
- Charge control agent [Valifast Black 3804] (Product of Orient Kagaku Kogyo Co., Ltd.)—1 wt. part
- Carbon black [MA-8] (Product of Mitsubishi Kasei Kogyo Co., Ltd.)—2 wt. parts The above-specified substances were melted and blended. After the cooling step, the blend was pulverized until toner particles having a diameter of about 15 microns were extracted by a classifying step. These toner particles were mixed with a minute quantity of fine powder silica acting as a fluidity improving agent thereby to prepare the desired toner A. This toner A has such characteristics that it is liable to be charged negative by friction.

Toner B (one-component insulating toner)

- Styrene-acryl resin [SBM 73] (Product of Sanyo Kasei Kogyo Co., Ltd.)—60 wt. parts
- Magnetite [EPT-1000] (Product of Toda Kogyo Co., Ltd.)—37 wt. parts
- Charge control agent [Valifast Black 3804] (Product of Orient Kagaku Kogyo Co., Ltd.)—1 wt. part
- Carbon black [MA-8] (Product of Mitsubishi Kasei Kogyo Co., Ltd.)—2 wt. parts The above-specified substances were melted and blended. After the cooling step, the blend was pulverized until toner particles having a diameter of about 15 microns were extracted by a classifying step. These toner particles were mixed with a minute quantity of fine powder silica acting as a fluidity improving agent thereby to prepare the desired toner B. This toner B has such characteristics that it is liable to be charged negative by friction.

Toner C (one-component conductive and magnetic toner)

- Styrene-acryl resin [SBM 73] (Product of Sanyo Kasei Kogyo Co., Ltd.)—60 wt. parts
- Magnetite [EPT-1000] (Product of Toda Kogyo Co., Ltd.)—34 wt. parts
- Charge control agent [Valifast Black 3804] (Product of Orient Kagaku Kogyo Co., Ltd.)—1 wt. part
- Low resistance carbon black [Ketjen Black] (Product of AKZO Co.)—5 wt. parts The above-specified substances were melted and blended. After the cooling step, the blend was pulverized until toner particles having a diameter of about 15 microns were extracted by a classifying step. These toner particles were mixed with a minute quantity of fine powder silica acting as a fluidity improving agent thereby to prepare the desired toner C. This toner C has such characteristics that it is liable to be charged negative by friction.

EXAMPLE 1

Figure 10:
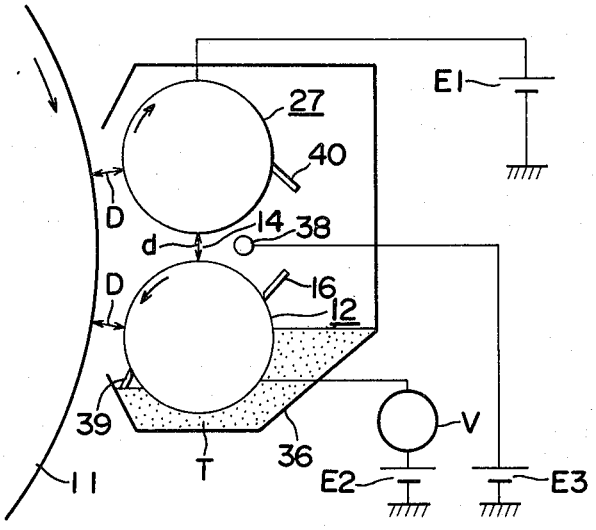
FIGS. 10 to 18 are explanatory views showing the constructions of the developing apparatus, which are used in the embodiments of the present invention, respectively.

Basically in accordance with the example shown in FIG. 8 except the provision of the preliminarily charging electrode plate 37, as shown in FIG. 10, the developing drum 12 and the juxtaposed drum 27, which were made of similar aluminum sleeves having rough surfaces of about 50 microns, were so arranged to construct the developing apparatus that the distance d at the closest positions was 1 mm and that the distances D at the closest positions from the latent image retaining drum 11 made of selenium were 1.5 mm. The latent image of positive charges, which was formed on the aforementioned latent image retaining drum 11 by the usual electronically photographic process, was developed by the use of the toner A under the following conditions:

The circumferential speed of the latent image retaining drum 11—120 mm/sec;

The circumferential speeds of the developing drum 12 and the juxtaposed drum 27—150 mm/sec;

The voltage of the d.c. power source E1 applied to the juxtaposed drum 27+100 V;

The voltage of the a.c. power source V applied to the developing drum 12—1500 V;

The frequency of the same a.c. power source V—5 KHz;

The voltage of the superposed d.c. power source E2 applied to the developing drum 12—+100 V; and The voltage of the d.c. power source applied to the cloud guiding electrode 38——200 V.

As a result, a visible picture image having a high resolution was formed.

EXAMPLE 2

The development was carried out absolutely similarly to the Example 1 by the developing apparatus, which was constructed similarly to the Example 1, except that the voltage of the d.c. power source E1 applied to the juxtaposed drum 27 was −100 V. As a result, a visible picture image having a similarly high resolution was obtained.

EXAMPLE 3

Figure 11:
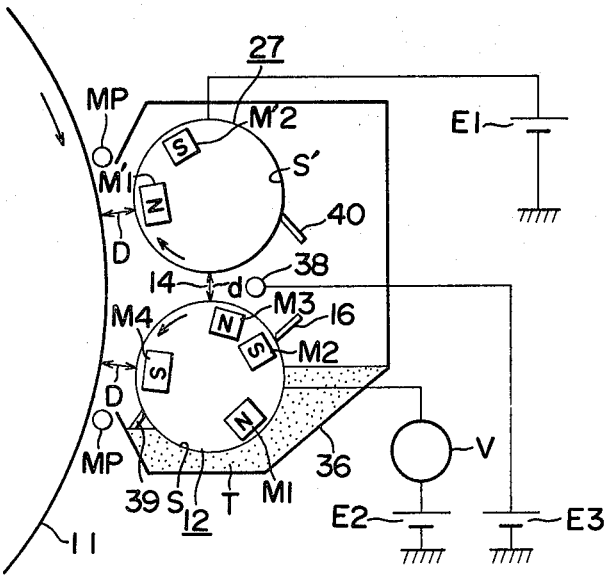

Basically in accordance with the example shown in FIG. 9 except the removal of the developing electrode 45, as shown in FIG. 11, the developing drum 12, which was equipped in the brass sleeve S with the magnet group (of which the toner vibration preventing magnet M3 was positioned in the vicinity of the portion closest to the juxtaposed drum 27), and the juxtaposed drum 27, whch was equipped with the magnet group in the sleeve S′ similar to the aforementioned sleeve S, were so arranged to construct the developing apparatus that the distance d at the closest positions was 1 mm and that the distances D at the closest positions from the latent image retaining drum 11 made of selenium were 1.5 mm. The latent image of positive charges, which was formed on the aforementioned latent image retaining drum 11 by the usual electronically photographic process, was developed by the use of the toner B under the following conditions. Incidentally, the toner supply regulating member 16 used was made of the magnetic blade.

The circumferential speed of the latent image retaining drum 11—120 mm/sec;

The circumferential speeds of the developing drum 12 and the juxtaposed drum 27—150 mm/sec;

The voltage of the d.c. power source E1 applied to the juxtaposed drum 27—+150 V;

The voltage to the a.c. power source V applied to the developing drum 12—1200 V;

The frequency of the same a.c. power source V—1 KHz;

The voltage of the superposed d.c. power source E2 applied to the developing drum 12—+150 V; and The voltage of the d.c. power source E3 applied to the cloud guiding electrode 38——300 V.

As a result, a visible picture image having a high resolution was obtained.

EXAMPLE 4

The development was carried out absolutely similarly to the Example 3 by the developing apparatus, which was constructed similarly to the Example 1, except that the voltage of the d.c. power source E1 applied to the juxtaposed drum 27 was −100 V. As a result, a visible picture image having more toner applied than the Example 3 and having a high resolution was obtained.

EXAMPLE 5

Figure 12:
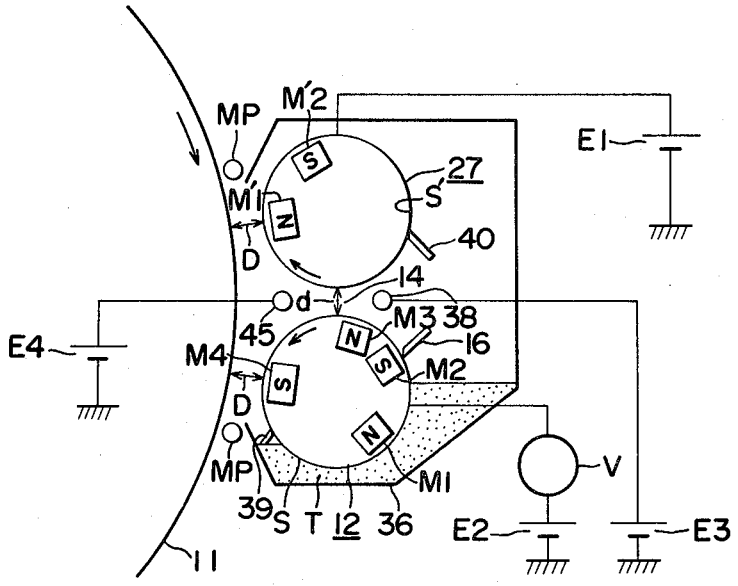

Basically in accordance with the example shown in FIG. 9, as shown in FIG. 12, the developing drum 12, which was equipped in the brass sleeve S with the magnet group (of which the toner vibration preventing magnet M3 was positioned in the vicinity of the position closest to the juxtaposed drum 27), and the juxtaposed drum 27, which was equipped with the magnet group in the sleeve S′ similar to the aforementioned sleeve S, were so arranged to construct the developing apparatus that the distance d at the closest positions was 1 mm and that the distances D at the closest positions from the latent image retaining drum 11 made of selenium were 1.0 mm. The latent image of positive charges, which was formed on the aforementioned latent image retaining drum 11 by the usual electronically photographic process, was developed by the use of the toner B under the following conditions. Incidentally, the toner supply regulating member 16 used was made of the magnetic blade.

The circumferential speed of the latent image retaining drum 11—120 mm/sec;

The circumferential speeds of the developing drum 12 and the juxtaposed drum 27—150 mm/sec;

The voltage of the d.c. power source E1 applied to the juxtaposed drum 27—+150 V;

The voltage of the a.c. power source V applied to the developing drum 12—1200 V;

The frequency of the same a.c. power source V—1 KHz;

The voltage of the superposed d.c. power source E2 applied to the developing drum 12—+150 V;

The voltage of the d.c. power source E3 applied to the cloud guiding electrode 38——300 V; and The voltage of the d.c. power source applied to the developing electrode——100 V.

As a result, a visible picture image having less toner applied than the Example 3 and having a high resolution was obtained.

EXAMPLE 6

Figure 13:
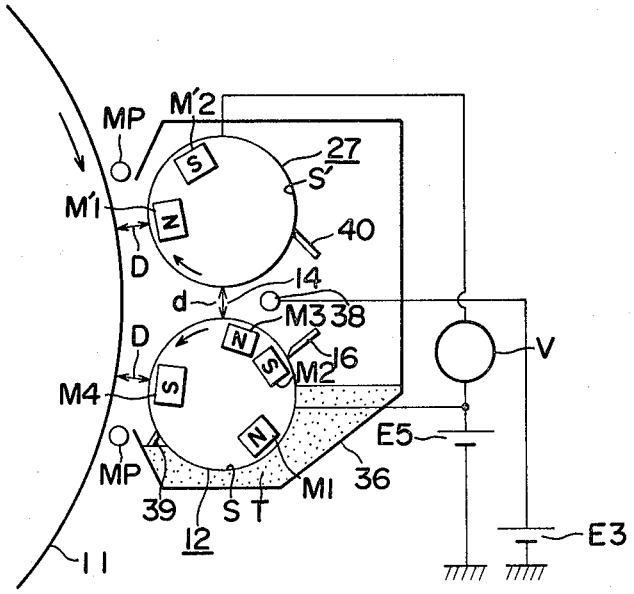

Basically in accordance with the example shown in FIG. 9 except the removal of the developing electrode 45, as shown in FIG. 13, the developing drum 12, which was equipped in the brass sleeve S with the magnet group (of which the toner vibration preventing magnet M3 was positioned in the vicinity of the portion closest to the juxtaposed drum 27), and the juxtaposed drum 27, which was equipped with the magnet group in the sleeve S' similar to the aforementioned sleeve S, were so arranged to construct the developing apparatus that the distance d at the closest positions was 1 mm and that the distances D at the closest positions from the latent image retaining drum 11 made of selenium were 1.0 mm. The latent image of positive charges, which was formed on the aforementioned latent image retaining drum 11 by the usual electronically photographic process, was developed by the use of the toner B under the following conditions. Incidentally, the toner supply regulating member 16 used was made of the magnetic blade.

The circumferential speed of the latent image retaining drum 11—120 mm/sec;

The circumferential speeds of the developing drum 12 and the juxtaposed drum 27—120 mm/sec;

The voltage of the a.c. power source V' applied to the juxtaposed drum 27—1200 V;

The frequency of the same a.c. power source V'—500 Hz;

The voltage of the d.c. power source E5 commonly connected with the developing drum 12 and the a.c. power source V'—0 V; and The voltage of the d.c. power source E3 applied to the cloud guiding electrode 38——300 V.

As a result, a visible picture image having a high resolution was obtained.

EXAMPLE 7

Figure 14:
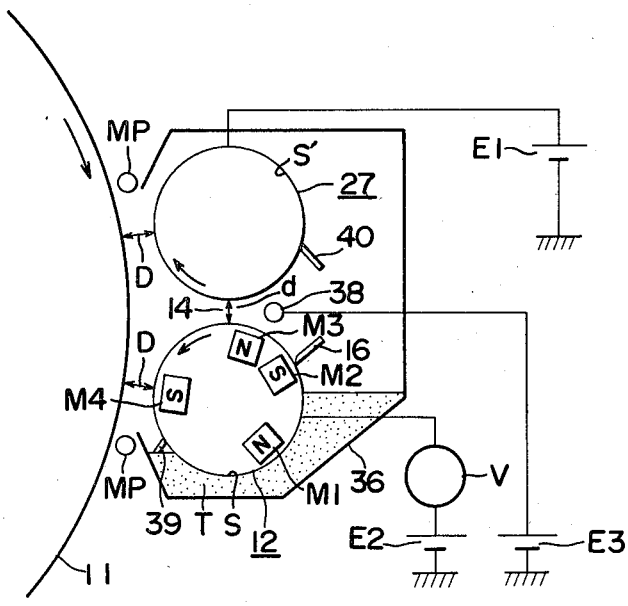

Basically in accordance with the example shown in FIG. 9 except the removal of the developing electrode 45, as shown in FIG. 14, the developing drum 12, which was equipped in the brass sleeve S with the magnet group (of which the toner vibration preventing magnet M3 was positioned in the vicinity of the portion closest to the juxtaposed drum 27), and the juxtaposed drum 27, which was made of the magnetic stainless steel sleeve S' but not equipped with the magnet group, were so arranged to construct the developing apparatus that the distance d at the closest positions was 1 mm and that the distances D at the closest positions from the latent image retaining drum 11 made of selenium was 1.0 mm. The latent image of positive charges, which was formed on the aforementioned latent image retaining drum 11 by the usual electronically photographic process, was developed by the use of the toner B under the following conditions. Incidentally, the toner supply regulating member 16 used was made of the magnetic blade.

The circumferential speed of the latent image retaining drum 11—120 mm/sec;

The circumferential speeds of the developing drum 12 and the juxtaposed drum 27—100 mm/sec;

The voltage of the d.c. power source E1 applied to the juxtaposed drum 27——200 V;

The voltage of the a.c. power source V applied to the developing drum 12—1200 V;

The frequency of the same a.c. power source V—1 KHz;

The voltage of the superposed d.c. power source E2 appllied to the developing drum 12——150 V; and The voltage of the d.c. power source E3 applied to the cloud guiding electrode 38——300 V.

As a result, a visible picture image having a high resolution was obtained.

EXAMPLE 8

Figure 15:
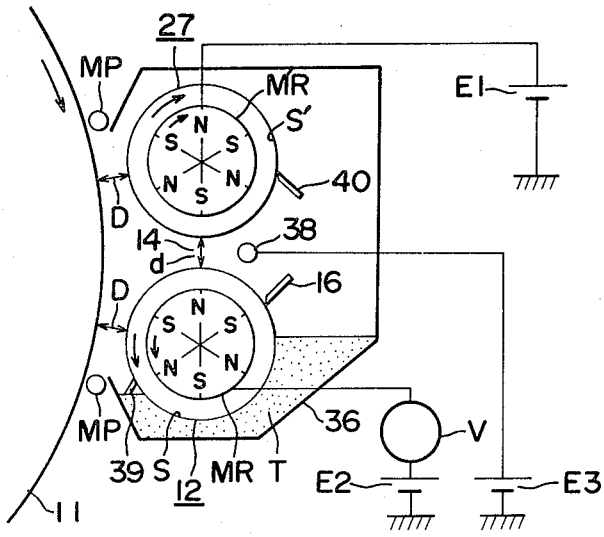

As shown in FIG. 15, the developing drum 12, which was equipped with a rotating magnet MR in the non-magnetic stainless steel sleeve S, and the juxtaposed drum 27, which was equipped with the sleeve S' and a magnet M'R made similar to the aforementioned sleeve S and magnet MR, respectively, were so arranged with the cloud guiding electrode 38 thereby to construct the developing apparatus that the sleeves S and S' and the magnets MR and M'R were rotated in the direction of arrows, that the distance d at the closest postions was 1 mm and that the distances D thereof at the closest positions from the latent image retaining drum 11 made of selenium were 1.0 mm. The latent image of positive charges, which was formed on the aforementioned latent image retaining drum 11 by the usual electronically photographic process, was developed by the use of the toner B under the following conditions. Incidentally, the toner supply regulating member 16 used was made of the magnetic blade.

The circumferential speed of the latent image retaining drum 11—120 mm/sec;

The circumferential speeds of the developing drum 12 and the juxtaposed drum 27—100 mm/sec;

The r.p.m. of the magnets MR and M'R—1000 r.p.m.;

The voltage of the d.c. power source E1 applied to the juxtaposed drum 27—+150 V;

The voltage of the a.c. power source V applied to the developing drum 12—1200 V;

The frequency of the same a.c. power source V—1 KHz;

The voltage of the superposed d.c. power source E2 applied to the developing drum 12—+150 V; and The voltage of the d.c. power source E3 applied to the cloud guiding electrode 38——300 V.

As a result, a visible picture image having a high resolution was obtained.

A similarly excellent visible picture image was also obtained in case the similar development was carried out while having the rotating directions of the magnets MR and M'R reversed and the sleeves S and S' left stationary.

EXAMPLE 9

Figure 16:
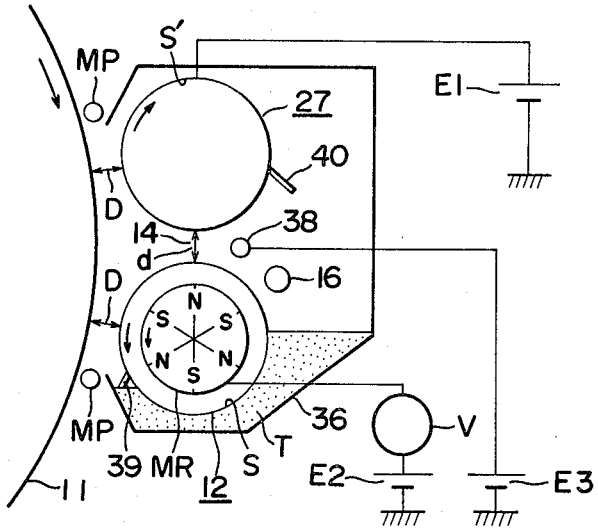

As shown in FIG. 16, the developing drum 12, which was equipped with the rotating magnet MR in the non-magnetic stainless steel sleeve S, and the juxtaposed drum 27, which was equipped with the magnetic stainless steel sleeve S', were so arranged with the cloud guiding electrode 38 thereby to construct the developing apparatus that the sleeves S and S' and the magnet MR were rotated in the direction of arrows, that the distance d at the closest positions was 1 mm and that the distances D at the closest positions from the latent image retaining drum 11 made of selenium were 1.0 mm. The latent image of positive charges, which was formed on the aforementioned latent image retaining drum 11 by the usual electronically photographic process, was developed by the use of the toner B under the following conditions. Incidentally, the magnetic blade having the shape shown in FIG. 5(E) and made of magnetic stainless steel was used as the toner supply regulating member 16.

The circumferential speed of the latent image retaining drum 11—120 mm/sec;

The circumferential speeds of the developing drum 12 and the juxtaposed drum 27—100 mm/sec;
the r.p.m. of the magnet MR—1000 r.p.m.;
The voltage of the d.c. power source E1 applied to the juxtaposed drum 27—+150 V;
The voltage of the a.c. power source V applied to the developing drum 12—1200 V;
The frequency of the same a.c. power source V—1 KHz;
The voltage of the superposed d.c. power source E2 applied to the developing drum 12—+150 V; and
The voltage of the d.c. power source E3 applied to the cloud guiding electrode 38—−300 V.

As a result, a visible picture image having a high resolution was obtained.

On the other hand, a similarly excellent visible picture image was also obtained in case the similar development was carried out while having the sleeve S left stationary.

EXAMPLE 10

Basically in accordance with the example shown in FIG. 9 except the removal of the developing electrode 45, as shown in FIG. 11, the developing drum 12, which was equipped in the brass sleeve S with the magnet group (of which the toner vibration preventing magnet M3 was positioned in the vicinity of the portion closest to the juxtaposed drum 27), and the juxtaposed drum 27, which was equipped with the magnet group in the sleeve S' similar to the aforementioned sleeve S, were so arranged with the cloud guiding electrode 38 thereby to construct the developing apparatus that the distance d at the closest positions was 1 mm and that the distances D at the closest positions from the latent image retaining drum 11 made of cadmium sulfide were 1.0 mm. The latent image of negative charges, which was formed on the aforementioned latent image retaining drum 11 by the usual electronically photographic process, was developed by the use of the toner C under the following conditions. Incidentally, the toner supply regulating member 16 used was of made of the magnetic blade.

The circumferential speed of the latent image retaining drum 11—120 mm/sec;
The circumferential speeds of the developing drum 12 and the juxtaposed drum 27—100 mm/sec;
The r.p.m. of the mgnet MR—1000 r.p.m.;
The voltage of the d.c. power source E1 applied to the juxtaposed drum 27—+150 V;
The voltage of the a.c. power source V applied to the developing drum 12—1200 V;
The frequency of the same a.c. power source V—1 KHz;
The voltage of the superposed d.c. power source E2 applied to the developing drum 12—+150 V; and
The voltage of the d.c. power source E3 applied to the cloud guiding electrode 38—+300 V.

As a result, a visible picture image having a high resolution was obtained.

EXAMPLE 11

Figure 17:
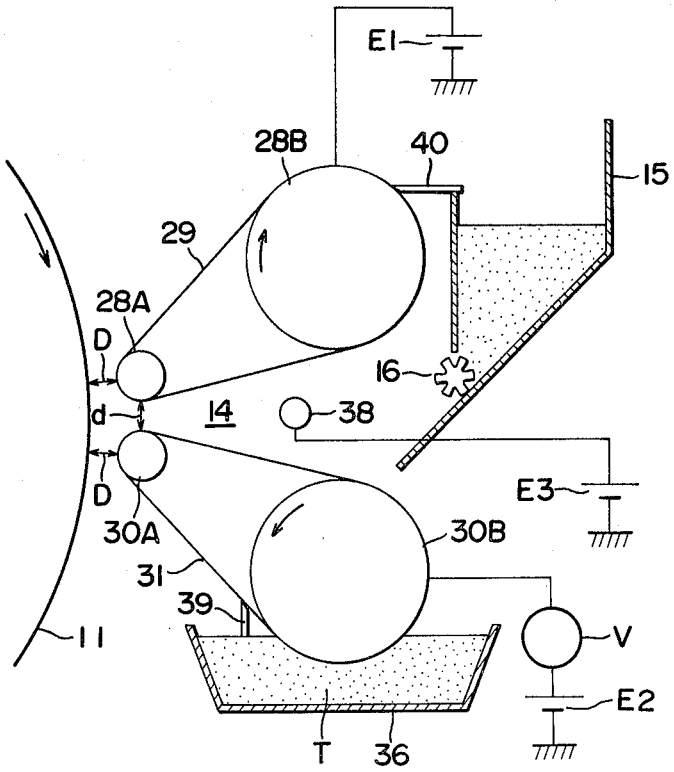

As shown in FIG. 17, the developing belt 31 of stainless steel, which was made to run on the guide rollers 30A and 30B, and the facing belt 29 of a similar construction, which was made to run on the guide rollers 28A and 28B, were so arranged to construct the developing apparatus that they were formed with such translational portions as had their spacing gradually reduced in their proceeding directions, that the distance d at the closest positions was 1 mm, that the distances D at the closest positions from the latent image retaining drum 11 made of the selenium drum were 1.5 mm, whereby the aforementioned translational portions were moved toward the latent image retaining drum 11, and that there was provided the cloud guiding electrode 38, whereby the toner was supplied from the toner hopper 15 onto the developing belt 31 by the action of the rotary type toner supply regulating member 16. The latent image of positive charges, which was formed on the aforementioned latent image retaining drum 11 by the usual electronically photographic process, was developed by the use of the toner A under the following conditions:

The circumferential speed of the latent image retaining drum 11—100 mm/sec;
The speeds of the developing belt 31 and the facing belt 29—150 mm/sec;
The voltage of the d.c. power source E1 applied to the facing belt 29—+100 V;
The voltage of the a.c. power source V applied to the developing belt 31—1500 V;
The frequency of the same a.c. power source V—5 KHz;
The voltage of the superposed d.c. power source E2 applied to the developing belt 31—+100 V; and
The voltage of the d.c. power source E3 applied to the cloud guiding electrode 38—−200 V.

As a result, a visible picture image having a high resolution was obtained.

EXAMPLE 12

Figure 18:
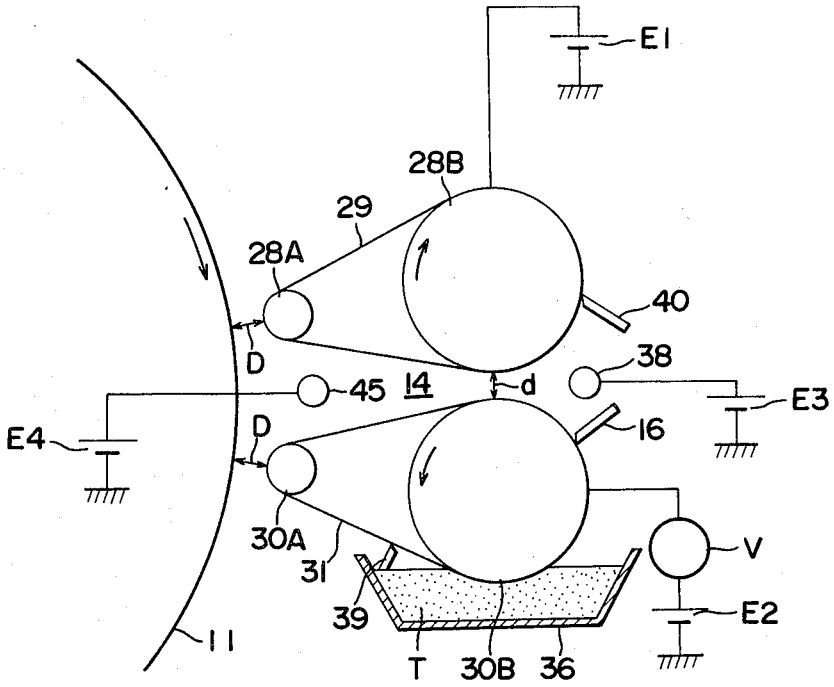

As shown in FIG. 18, the developing belt 31 of stainless steel, which had a surface roughness of about 50 microns and which was made to run on the guide rollers 30A and 30B, and the facing belt 29 of a similar construction, which was made to run on the guide rollers 28A and 28B, were so arranged to construct the developing apparatus that they were formed with such translational portions as had their spacing gradually reduced in their proceeding directions, that the distance d at the closest positions was 1 mm, that the distances D at the closest positions from the latent image retaining drum 11 made of the selenium drum were 1.5 mm, whereby the aforementioned translational portions were moved toward the latent image retaining drum 11, and that there were provided the cloud guiding electrode 38 and the developing electrode 45, whereby the toner was supplied from the toner tank 36 onto the developing belt 31. The latent image of positive charges, which was formed on the aforementioned latent image retaining drum 11 by the usual electronically photographic process, was developed by the use of the toner A under the following conditions:

The circumferential speed of the latent retaining drum 11—100 mm/sec;
The speeds of the developing belt 31 and the facing belt 29—150 mm/sec;
The voltage of the d.c. power source E1 applied to the facing belt 29—−50 V;
The voltage of the a.c. power source V applied to the developing belt 31—1500 V;
The frequency of the same a.c. power source V—5 KHz;
The voltage of the superposed d.c. power source E2 applied to the developing belt 31—+100 V;
The voltage of the d.c. power source E3 applied to the cloud guiding electrode 38—−200 V; and The voltage of the d.c. power source E4 applied to the developing electrode 45—+50 V.

As a result, a visible picture image having a high resolution was obtained.

Figure 19:
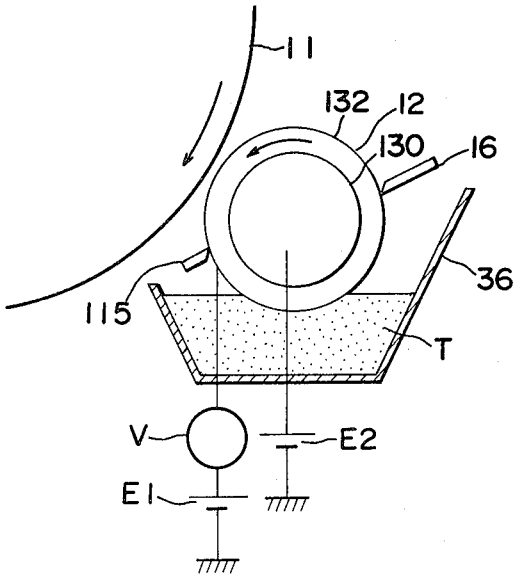
FIG. 19 is an explanatory view showing the construction of a further embodiment of the present invention.
Figure 20:
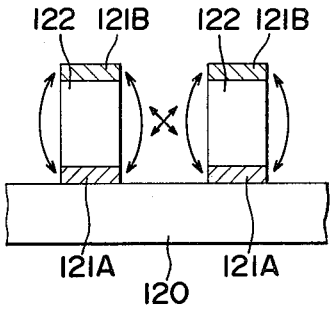
FIGS. 20 to 32 are explanatory views illustrating those concrete constructional examples of an electrode pair, which are effectively used in the present invention, respectively.

FIG. 19 shows another embodiment of the developing apparatus of the present invention using charging means. In this embodiment, there is disposed at the developing region of the latent image retaining drum 11 of a photoconductive and photosensitive material the developing drum 12 which is faced to the latent image retaining drum 11 and by which the toner T reserved in the toner tank 36 is conveyed to the aforementioned developing region. In the developing apparatus thus constructed, the developing drum 12 acting as the toner conveyor has a surface formed by a number of electrode pairs, each of which is composed of a first electrode and a second electrode spaced from the first electrode through a charging space, and an a.c. power source is so connected between the aforementioned first and second electrodes as to establish an alternating electric field. One example of the constructions of the aforementioned electrode pairs will be described in the following. As shown in FIG. 20, for example, on an insulating retaining layer 120 disposed on a substrate, there is formed in a protruding manner a first electrode 121A, on which a second electrode 121B is formed through an insulating member 122, thus forming a number of electrode pairs having such construction.

According to the construction thus made, the toner particles supplied to the surface portion of that developing drum 12 are vibrated either in the direction of arrows in the charging space, which extends along the sides of the insulating member 122 between the first and second electrodes 121A and 121B constructing each electrode pair, by the action of the alternating electric field established in that space or between the first and second electrodes 121A and 121B which are adjacent to each other through that space, until they are charged.

Figure 21:
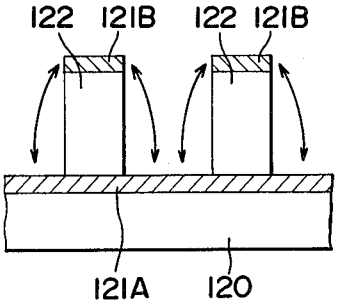

The concrete construction of the electrode pair composed of the aforementioned first and second electrodes 121A and 121B can be modified in various manners, as follows:

The example shown in FIG. 21 is constructed such that the first electrode 121A is so disposed as to cover the surface of the insulating retaining layer 120 and such that there is disposed on the first electrode 121A the insulating member 122 on which the second electrode 121B is formed.

Figure 22:
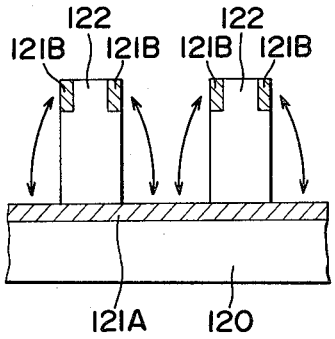

The example of FIG. 22 is constructed such that a plurality of the second electrodes 121B are formed on the insulating member 122 in the example of FIG. 21.

Figure 23:
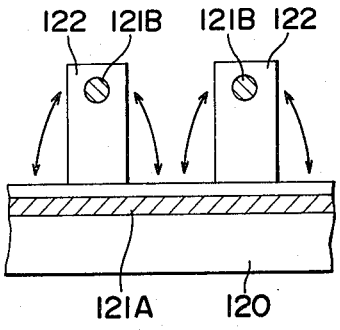

The example of FIG. 23 is constructed such that the first electrode 121A is buried in the insulating retaining layer 120 along the surface of the same and such that the second electrode 121B is buried in the insulating member 122 which is formed to project from the surface of the insulating retaining layer 120.

Figure 24:
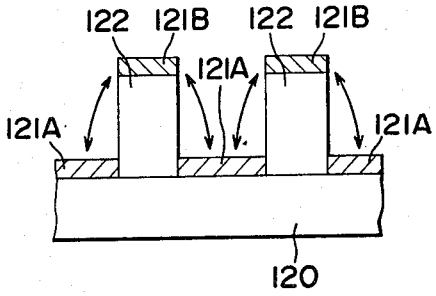

The example of FIG. 24 is constructed such that the insulating members 122 are formed to protrude from the surface of the insulating retaining layer 120, such that the first electrode 121A is disposed on the surface of the aforementioned insulating retaining layer 120 between those insulating members 122 and such that the second electrode 121B is disposed on each of the aforementioned insulating members 122.

Figure 25:
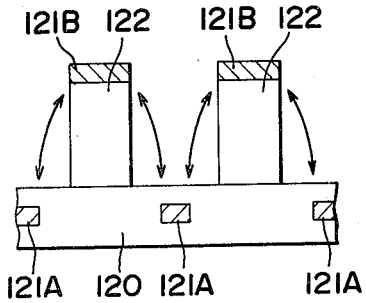

The example of FIG. 25 is constructed such that the insulating member 122 is formed to protrude from the surface of the insulating retaining layer 120, such that the first electrode 121A is buried in the insulating retaining layer 120 along the exposed surface portion of the same and such that the second electrode 121B is disposed on the aforementioned insulating member 122.

Figure 26:
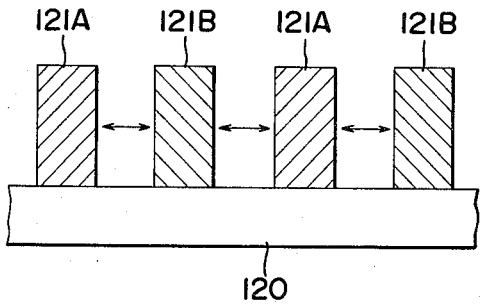

The example of FIG. 26 is constructed such that the first and second electrodes 121A and 121B are so formed in a protruding manner as to face each other through a space along the surface of the insulating retaining layer 120.

Figure 27:
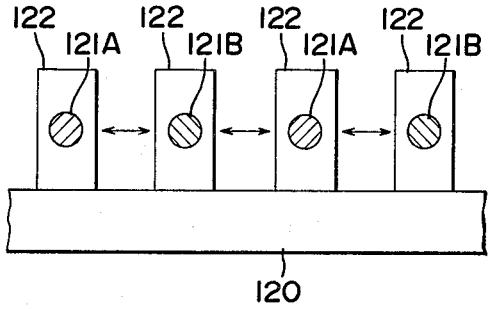

The example of FIG. 27 is constructed such that the insulating members 122 and 122 are so formed on the insulating retaining layer 120 as to face each other through a space and such that the first and second electrodes 121A and 121B are buried in the insulating members 122 which are alternately adjacent to each other.

Figure 28:
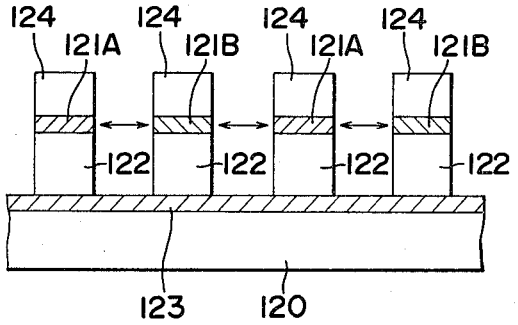

The example of FIG. 28 is constructed such that there is disposed on the insulating retaining layer 120 a control electrode 123 on which the insulating members 122 and 122 are so formed in a protruding manner as to face each other through a space, such that the first and second electrodes 121A and 121B are disposed on the insulating members 122 and 122 which are alternately adjacent to each other, and such that other insulating members 124 and 124 are disposed on the first and second electrodes 121A and 121B, respectively.

Figure 29:
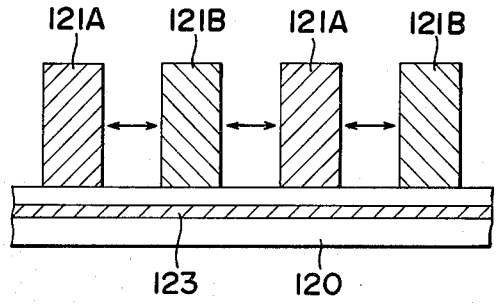

The example of FIG. 29 is constructed such that the control electrode 123 is buried in and along the surface of the insulating retaining layer 120 and such that the first and second electrodes 121A and 121B are disposed on the surface of the insulating retaining layer 120 similarly to the case of FIG. 26.

Figure 30:
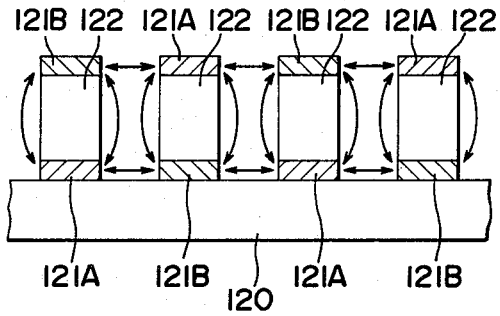

The example of FIG. 30 is constructed such that the first and second electrodes 121A and 121B are disposed similarly to the example of FIG. 26 and such that the second electrode 121B is disposed on each first electrode 121A through the insulating member 122 whereas the first electrode 121A is disposed on each second electrode 121B through the insulating member 122.

Figure 31:
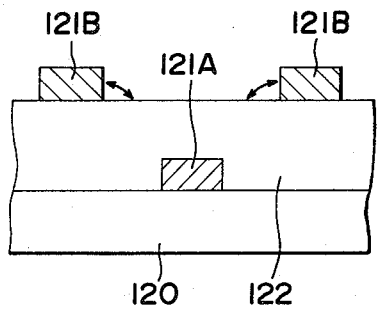

The example of FIG. 31 is constructed such that the first electrode 121A is formed to protrude from the insulating retaining layer 120, such that the insulating member 122 is so disposed on the insulating retaining layer 120 so that the first insulating electrode 121A may be buried therein, and such that the second electrodes 121B and 121B are disposed to protrude from those regions of the surface of that insulating member 122, which are adjacent to the region corresponding to the aforementioned first electrode 121A.

Figure 32:
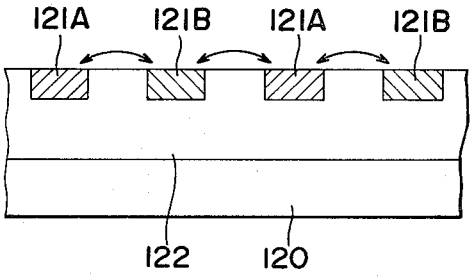

The example of FIG. 32 is constructed such that the first and second electrodes 121A and 121B are so buried in the surface portion of the insulating member 122 disposed on the insulating retaining layer 120 as to be alternately spaced from each other so that they are formed with such exposed surfaces as extend along the surface of the insulating member 122.

As a result, the toner particles are vibrated and charged, as indicated at arrows. Moreover, the control electrode 123 is made operative, when a suitable d.c. voltage is applied thereto, to control the vibrating states of the toner particles and accordingly the charged state of the toner.

As in the respective examples of the constructions thus far described, it is sufficient to form the space for allowing the vibrations of the toner particles thereby to provide the charging space, but the directions of the vibrations themselves are not restricted. Various constructions other than the aforementioned ones can be conceived. In order to charge the toner at the state required therefore, it is naturally essential that the material of the portion, upon which the toner particles are vibrated to impinge, be selected while taking the frictionally charged order into consideration. In the respective constructional examples shown, incidentally, the electrodes 121A or 121B are illustrated in a rectangular shape for convenience only, but that rectangular shape is not always preferred in view of the requirements such as for the discharge at the edge portions to be depressed, as for the lines of electric force to effectively act upon the toner or as in production. On the other hand, a resin or rubber is usually used as the material for the insulating retaining layer 120 and the insulating members 122 and 124, and a resin, in which conductive powders are dispersed, or metal is preferably used as the material for the first and second electrodes 121A and 121B and the control electrode 123.

Although, in the foregoing description, the concrete examples of the constructions of the electrode pairs, which are effective in the present invention, have been conceptionally or schematically presented, the electrode pairs can be produced in the following manners, for example:

Production 1

Figure 33A:
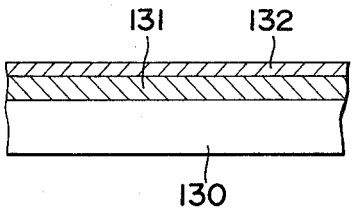
FIGS. 33(A), 33(B) and 33(C) are explanatory sections illustrating that producing method of a developing drum, which can be used in the present invention, in the order of its steps.
Figure 33B:
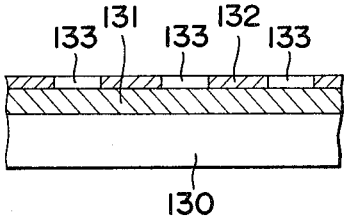
Figure 33C:
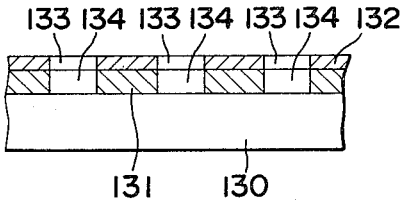

An aluminum drum having a diameter of 50 mm was used as the substrate. As shown in FIG. 33(A), this substrate 130 was coated on its outer circumference with an alkyd resin having a thickness of about 40 microns by the dipping process thereby to form an insulating layer 131 and was then formed with a metal layer 132 of copper having a thickness of about 20 microns by the sputtering process. After that, by the use of a photo resist and the etching technique, the aforementioned metal layer 132 was formed with pores 133 having a diameter of 70 microns, which were regularly arranged, as shown in FIG. 33(B). By the use of a solvent, as shown in FIG. 33(C), those portions of the insulating layer 131, which were exposed to the outside through those pores 133, were dissoloved and removed to form pores 134, through which the surface of the substrate was exposed to the outside, thus producing the developing drum. The drum thus produced has the construction of the electrode pairs similar to that shown in FIG. 21, if the substrate 130 is used as the first electrode whereas the remainder of the metal layer 132 is used as the second electrode.

Production 2

Figure 34:
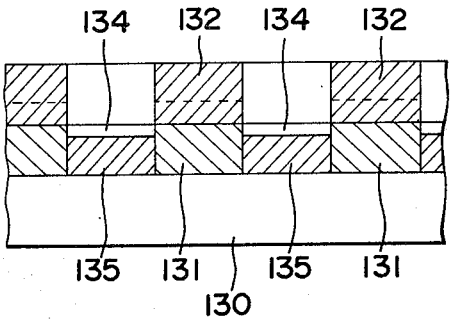
FIG. 34 is an explanatory section illustrating another producing method of the developing drum.

The construction obtained in the Production 1 had its surface further coated with copper having a thickness of about 30 microns by the sputtering process thereby to enlarge the thickness of the metal layer 132 on the insulating layer 131, as shown in FIG. 34, and the exposed surface of the substrate 130, i.e., the aforementioned pores 134 of the same were covered with a metal layer 135. The drum thus produced has the electrode construction similar to that shown in FIG. 24, if the metal layer 135 is used as the first electrode whereas the metal layer 132 is used as the second electrode.

Production 3

Figure 35A:
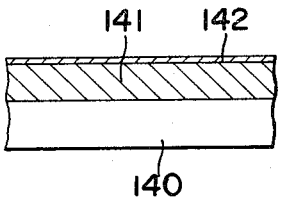
FIGS. 35(A) and 35(B), and FIGS. 36(A), 36(B), 36(C) and 36(D) are explanatory sections illustrating further producing methods of the developing drum, respectively, in the order of their steps.
Figure 35B:
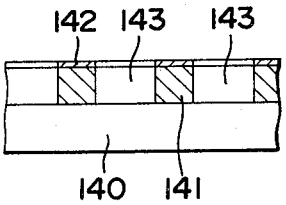

An aluminum drum having a diameter of 30 mm was used as the substrate. As shown in FIG. 35(A), this substrate 140 was formed on its outer circumference with an insulating photo resist film 141 having a thickness of about 50 microns by the dipping process and was further formed thereon with a conducting photo resist film 142 having a thickness of about 2 microns, in which conductive carbon was dispersed, by the dipping process. Then, by the process for effecting the optical irradiation by the use of a mask and for subsequently dissolving and removing the portions left unset, as shown in FIG. 35(B), the aforementioned conducting and insulating photo resist films 142 and 141 were formed with pores 143 having a diameter of 100 microns, which were regularly arranged. The drum thus produced has the electrode pair construction similar to that shown in FIG. 21, if the substrate 140 is used as the first electrode whereas the remainder of the conducting photo resist film 142 is used as the second electrode.

Production 4

Figure 36A:
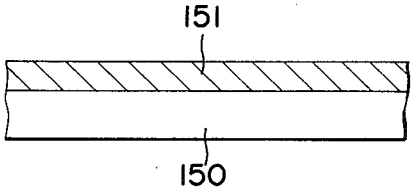
Figure 36B:
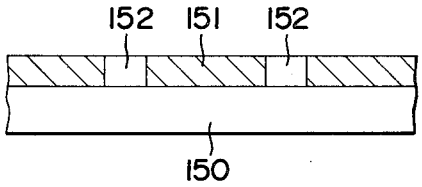
Figure 36C:
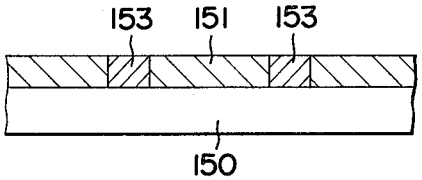
Figure 36D:
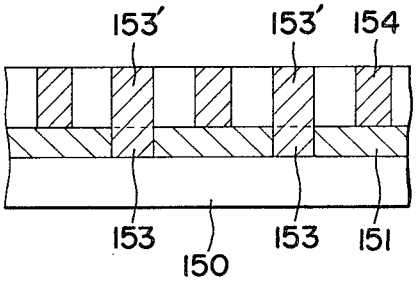

An aluminum drum having a diameter of 50 mm was used as the substrate. As shown in FIG. 36(A), this substrate 150 was formed on its outer circumference with an insulating layer 151 having a thickness of about 50 microns. After that, as shown in FIG. 36(B), that insulating layer 151 was formed with regularly arranged pores 152 having a diameter of 70 microns and was so coated on its whole surface with copper that the pores 152 might be filled up. After that, the copper on the aforementioned insulating layer 151 was polished and removed to leave metal layers 153 in the aforementioned pores 152. The surface thus polished was further coated with copper having a thickness of about 100 microns by the use of the sputtering process using a mask thereby to form a metal layer 153' on the aforementioned metal layer 153, as shown in FIG. 36(D), and such a metal layer 154 was formed on the aforementioned insulating layer 151 as was wholly continuous to have its portion extending along the circumference about each of those metal layers 153'. The drum thus produced has the electrode pair construction similar to the example of FIG. 26, if the integrated metal layers 153 and 153' are used as the first electrode whereas the metal layer 154 is used as the second electrode.

By the action of the developing drum 12 having the construction thus far described, the toner is charged while being conveyed. The toner thus charged is conveyed by the action of said developing drum 12 in addition to the electric force resulting from the charges to the developing region, in which the latent image retaining drum 11 is faced by that developing drum 12, so that it is used for the development by the well-known developing manner, whereby the electrostatic latent image on its retaining drum 11 is visualized.

Incidentally, as will be understood from the foregoing Productions, it is preferred, in case the developing drum is used, that its substrate drum be made of metal so that it may be used as the conduction passage for the first electrode. In case the insulating drum is used as the substrate drum, on the contrary, it is sufficient that the outer circumference thereof be coated with a metal layer. On the other hand, like construction is applied in case the developing drum is replaced by a belt. Moreover, the second electrode can easily realize the power supply thereby if it is made of a continuous net as a whole.

The developing apparatus of FIG. 19 is equipped with the drum, which was made by the foregoing Production 1, as the developing drum 12. The metal layer 132 is connected with the a.c. power source V and the d.c. power sourcd E1 in a superposed manner, and the substrate 130 is connected with the d.c. power source E2. The toner particles, which are supplied in the form of a layer having a thickness of 100 microns at most, are longitudinally vibrated and charged in the inner walls of the pores 134, while being conveyed by the developing drum 12, by the actions of those power sources until they are applied to the electrostatic latent image on the latent image retaining drum 11 thereby to develop the same. A power source having a frequency of 50 Hz to 50 KHz and a voltage of 10 V to 2 KV is used as the a.c. power source V, and a power source having a positive or negative voltage of 0 to 500 V is used as the d.c power source E1 or E2. Moreover, the distance between the latent image retaining drum 11 and the developing drum 12 is held at as large as 0 to 500 microns and is desired to be larger than the thickness of the toner layer on the developing drum 12. Reference numeral 115 indicates a cleaning member which is used to recover the toner, which has not been used for the development in the developing region, to the toner tank 36.

Figure 37:
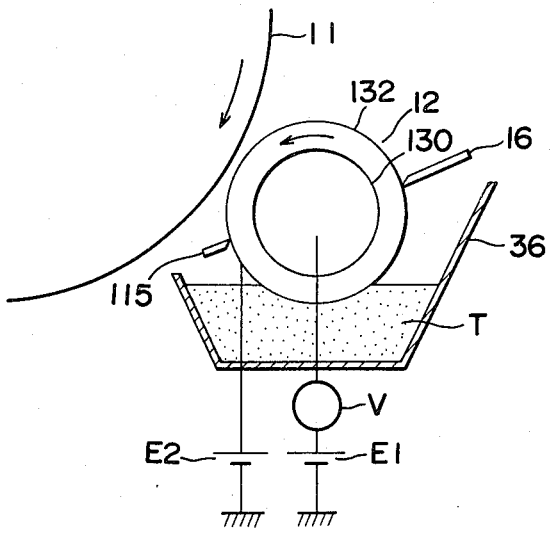
FIGS. 37 and 38 are explanatory views showing the constructions of further embodiments of the present invention.

The developing apparatus of FIG. 37 has the construction similar to that of FIG. 19 except that the a.c. power source V and the d.c. power source E1 to be superposed on the former are connected with the substrate 130 and that the d.c. power source E2 is connected with the metal layer 132. In this case, too, a power source having the frequency of 50 Hz to 50 KHz and the voltage of 10 V to 2 KV is used as the a.c. power source V, and a power source having the positive or negative voltage of 0 to 500 V is used as the d.c. power source E1 or E2. Moreover, it is preferred that the distance between the latent image retaining drum 11 and the developing drum 12 be held at about 0 to 500 microns or larger than the thickness of the toner layer on the developing drum 12.

Figure 38:
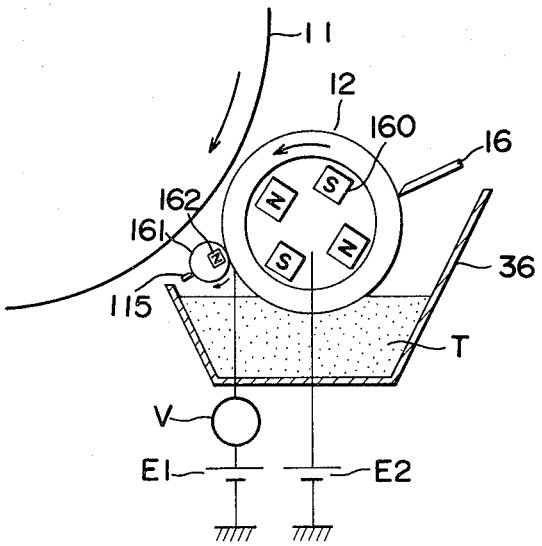

The example of FIG. 38 is directed to the developing apparatus which is suitable in case magnetic toner is used as the toner and which is equipped with a magnet 160 in addition to the construction of FIG. 19 so that the toner is conveyed by the magnetic force of that magnet 160. Moreover, the cleaning unit is equipped with a rotary sleeve 161 having a magnet 162 therein so that the toner having failed to be used for the development is recovered. The developing conditions are similar to those of the case in which the apparatus of FIG. 19 is used.

Excellent development could be achieved in any of the development tests which were conducted by the use of the respective developing apparatus having the aforementioned constructions shown in FIGS. 19, 37 and 38.

In the present invention, the toner conveyor such as the developing drum or belt for conveying the toner to the developing region is equipped with the numerous electrode pairs, each of which is composed of the first and second electrodes, and the toner is charged by the action of the alternating electric field. As a result, the toner can be charged to a desired state thereby to attain excellent development. At the same time, said toner conveyor itself has a toner charging function. As a result, the space to be occupied by the apparatus can be reduced without any necessity for any independent toner charging mechanism so that the construction as a whole can be remarkably simplified and so that both the conveyance of the toner and the control of the development by the voltage applied can be facilitated.

What is claimed is:

1. A developing method characterized: in that a developing agent is introduced into a developing agent cloud forming space, in which an alternating electric field is to be established, so that said developing agent may be made to fly therein by the action of said alternating electric field thereby to form the cloud of said developing agent; and in that the cloud of said developing agent is guided to a developing region thereby to develop a latent image.

2. A developing method as set forth in claim 1, further characterized in that said developing agent cloud forming space is defined between a pair of charging members facing each other so that the cloud of said developing agent is formed of the charged particles of said developing agent.

3. A developing method as set forth in claim 1 or 2, further characterized in that said developing agent is a magnetic developing agent.

4. A developing method as set forth in claim 3, characterized in that said magnetic developing agent consists of a toner.

5. A developing apparatus comprising: an endless developing agent conveyor adapted to move in a manner to face a moving latent image retainer; a developing agent supply mechanism for supplying a developing agent to said developing agent conveyor; and an alternating electric field establishing mechanism for establishing an alternating electric field in a developing agent cloud forming space of said developing agent conveyor, which is located in a region close to said latent image retainer.

6. A developing apparatus comprising: a first developing agent conveyor adapted to move in a manner to face a moving latent image retainer; a second developing agent conveyor adapted to move in a manner to face both said latent image retainer and said first developing agent conveyor; a developing agent supply mechanism for supplying a developing agent to at least one of said first and second developing agent conveyors; and an alternating electric field establishing mechanism for establishing an alternating electric field in a developing agent cloud forming space which is defined between said first and second developing agent conveyors facing each other.

7. A developing apparatus comprising a developing agent conveyor for conveying a developing agent, wherein said developing agent conveyor includes a multiplicity of pairs of electrodes each composed of a first electrode and a second electrode juxtaposed to said first electrode through a charging space so that an alternating electric field is established in said charging space by using said first and second electrodes.

8. A developing apparatus as set forth in claim 7, wherein said developing agent is a magnetic developing agent.

9. A developing apparatus as set forth in claim 7, wherein said magnetic developing agent consists of a toner.

10. A developing apparatus as set forth in claim 7, 8 or 9, wherein an alternating voltage having a d.c. voltage superposed is applied between said first and second electrodes.

* * * * *